United States Patent [19]

Southern

[11] 4,165,868

[45] Aug. 28, 1979

[54] METHOD AND APPARATUS FOR HEATING COILS OF STRIP

[75] Inventor: Raymond L. Southern, Lower Burrell, Pa.

[73] Assignee: Allegheny Ludlum Industries, Inc., Pittsburgh, Pa.

[21] Appl. No.: 855,093

[22] Filed: Nov. 25, 1977

[51] Int. Cl.[2] ..... C21D 9/54

[52] U.S. Cl. ..... 266/264; 148/16; 266/252; 432/254.2; 432/260

[58] Field of Search ..... 266/252, 255–257, 266/262–264, 274; 432/254.2, 260

[56] References Cited

U.S. PATENT DOCUMENTS

| | | | |
|---|---|---|---|
| 2,083,638 | 6/1937 | Cope | 266/252 |
| 2,983,502 | 5/1961 | McClure | 432/260 |
| 3,149,827 | 9/1964 | Whitten | 432/260 |
| 3,581,810 | 6/1971 | Blackman | 266/256 |

FOREIGN PATENT DOCUMENTS

| | | | |
|---|---|---|---|
| 467515 | 8/1950 | Canada | 266/256 |
| 544516 | 8/1957 | Canada | 266/256 |
| 957004 | 2/1950 | France | 432/260 |
| 523947 | 10/1976 | U.S.S.R. | 266/256 |

*Primary Examiner*—Gerald A. Dost

*Attorney, Agent, or Firm*—Vincent G. Gioia; Robert F. Dropkin; William J. O'Rourke, Jr.

[57] ABSTRACT

Coils of strip to be annealed are placed in a furnace with their eye vertical and are heated to the annealing temperature by heating elements on the furnace above and below the level of the coils. An improved convector coil support includes a single metal plate having a central opening and grooves in one side extending from the central opening to the outer periphery when used to support a bottom coil and two such plates fastened together with their grooves facing each other when the convector is used to support a coil on top of a coil.

4 Claims, 6 Drawing Figures

FIG. 2.
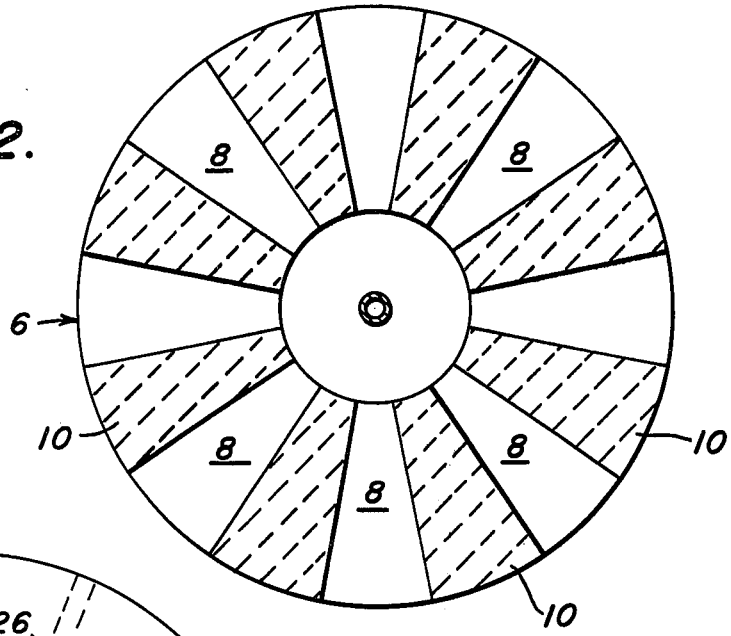
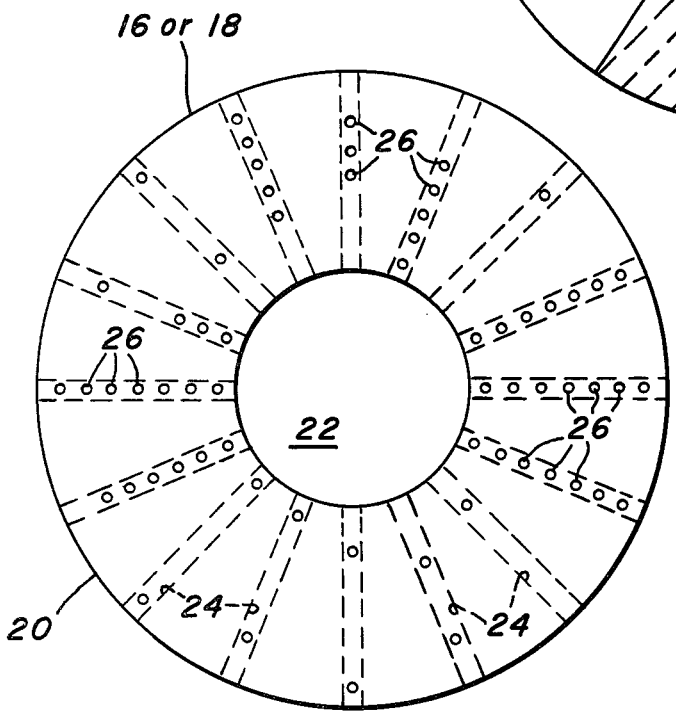
FIG. 3.
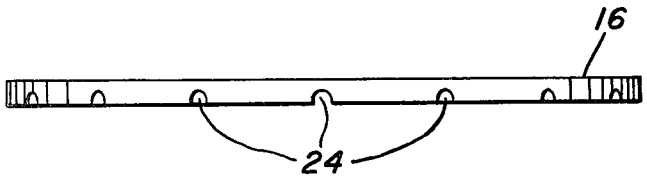
FIG. 4.
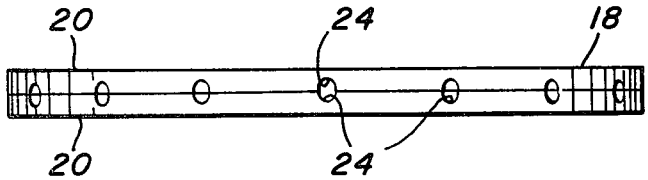
FIG. 5.

METHOD AND APPARATUS FOR HEATING COILS OF STRIP

This invention relates to a method and apparatus for heating coils of strip and more particularly for annealing coils of silicon steel strip. The strip is usually annealed in either a tunnel furnace or in a bell furnace. In the tunnel furnace the coils are mounted one high on a conveyor and move through the furnace from the entry to exit end. The coil is heated starting at the entry end by heating elements mounted on the sidewalls at the same elevation as the coils. In the bell furnace a coil or two or more coils one on top of the other are mounted on a base with their eyes vertical. An inner cover made of a single thickness of metal is placed over the coil and forms an enclosure for the annealing atmosphere. An outer cover is placed over the inner cover and the coil is heated by heating elements mounted on its sidewalls at the same elevation as the coil. In both types of furnaces the radiant energy from the heating elements is directed to the outer wraps of each coil. These methods of heating coils result in distorted outer wraps (as much as 3 inches in), heat tint throughout the coil, bare spots up to 3 inches into the coil, and poor base coating development. Thus there is a reduced yield and/or poor strip appearance. It has been suggested to wrap insulation around at least the top part of the coil, but this has only been partially successful.

According to my invention I reduce the heat input to the outer wraps of the coils by concentrating the radiant energy of the annealing furnace heating elements on the ends of the coils rather than the lateral surfaces of the coils. This reduces the temperature of the outer wraps of the coil and eliminates the problems previously discussed. Since heat transfer to the cold spot of the coil (mid-buildup and mid-width) is much easier in the axial direction than in the radial direction, the efficiency is improved.

The resistance of radial heat transfer per unit depth into a coil may be as much as 20 times greater than the resistance to axial heat transfer per unit depth into a coil. Thus the rate of heat supplied to the ends of the coils (i.e. axial heating) is the controlling factor in heating the coil cold spot to annealing temperature. The magnitude of this difference in resistance to heat transfer is dependent on the tightness of the coil wraps, type and thickness of strip coating (if any), type of furnace atmosphere, etc. Specifically, I place the heating elements above and below the level of the coils in the furnace.

It is therefore an object of my invention to provide a method and apparatus for heating coils of strip which eliminates or greatly reduces damage to the outer wraps of the coils.

Another object is to provide an improved convector coil support.

These and other objects will be more apparent after referring to the following specification and attached drawings in which:

FIG. 2 is a view taken on the line II—II of FIG. 1;

FIG. 3 is a top plan view of the convector coil supports of my invention;

FIG. 4 is a side elevation of the convector of FIG. 3;

FIG. 5 is a view, similar to FIG. 4, but showing a different embodiment of my invention.

Figure 1:
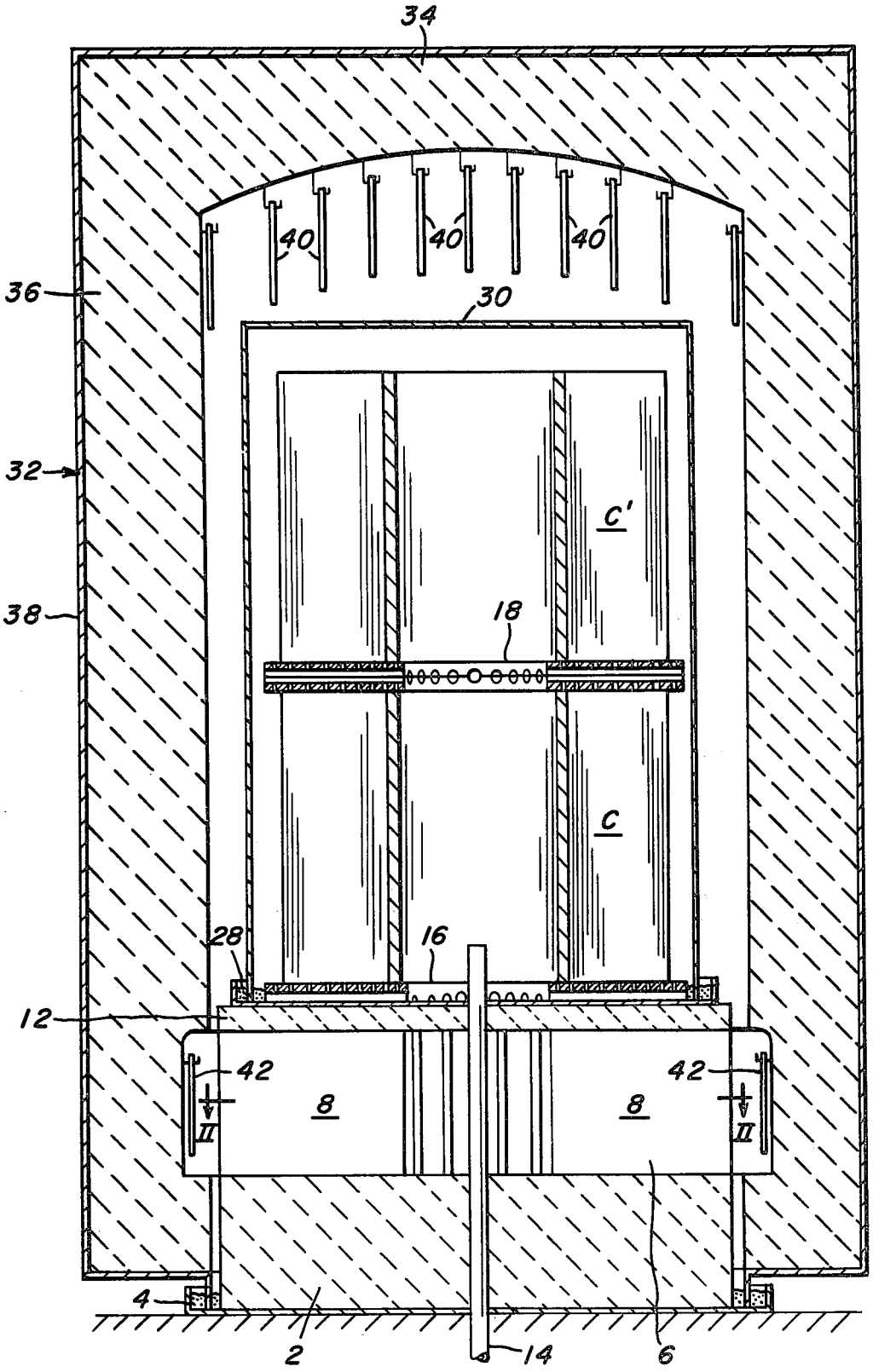
FIG. 1 is a schematic sectional view of a bell type furnace incorporating my invention.

Referring more particularly to FIG. 1 reference numeral 2 indicates the refractory base of a bell type furnace having a sand seal 4 at its bottom. Mounted on top of base 2 is an open support base 6 having radial openings 8 between refractory walls 10. A refractory hearth plate 12 is mounted on top of base 6. An annealing gas inlet pipe 14 extends upwardly through the base 2 for discharge above the hearth plate 12. A convector coil support 16 is mounted on top of hearth plate 12. A first coil of strip C is mounted on support 16 and a convector coil support 18 is placed on top thereof for supporting a second coil of strip C'.

As shown in FIGS. 3 and 4 convector coil support 16 consists of a single metal plate 20 having a central opening 22 therein and a plurality of grooves 24 in its lower surface extending from opening 22 to the outer periphery thereof. Spaced apart vertical diffusion holes 26 (only part of which are shown) extend from grooves 24 to the upper surface of plate 20.

Convector coil support 18 as shown in FIG. 5 consists of two plates 20 fastened together in any suitable way, such as by welding, with their grooves 24 facing each other.

A sand seal 28 is provided on top of hearth plate 12 for receiving an inner cover 30. While a base 2 and sand seal 28 are shown for supporting one coil or stack of coils of strip it will be understood that a similar arrangement may be provided for supporting a plurality of stacks of coils each stack being covered by an inner cover 30.

An outer cover 32 surrounds the inner cover or covers 30 with its bottom received in sand seal 4. The cover 32 includes a refractory roof 34 supported by refractory walls 36 and all surrounded by a metal shell 38. Electrical heating elements 40 are suspended from the roof 34 in any suitable manner and similar heating elements 42 are supported by walls 38 at the level of open support base 6. Other heating means, such as combustion tubes, may be used in place of the electrical heating elements. In any case means (not shown) are preferably provided for controlling the upper heating elements 40 separately from the lower heating elements 42.

The parts described above are conventional except for the convector coil supports 16 and 18 and the location of heating elements 40 and 42.

In operation, the furnace is loaded in the usual manner as shown in FIG. 1. Heat is then applied by the heating elements 40 and 42 and annealing gas is supplied through pipe 14. Since the heating elements are no longer at the level of the coils of strip being annealed heat is supplied to the top end of the coils by radiation from the heating elements 40 and to the bottom end by radiation from the heating elements 42. The annealing gas circulates upwardly through the eyes of the coils of strip and downwardly on the outside of the coils and through openings 8. In addition annealing gas passes through grooves 24 and openings 22 in convector coil supports 16 and 18. Thus heat is supplied to the coils primarily from their ends with the heat being supplied to the outer convolutions of the coil from the annealing gas flowing therepast being insufficient to damage the outer convolutions.

Figure 6:
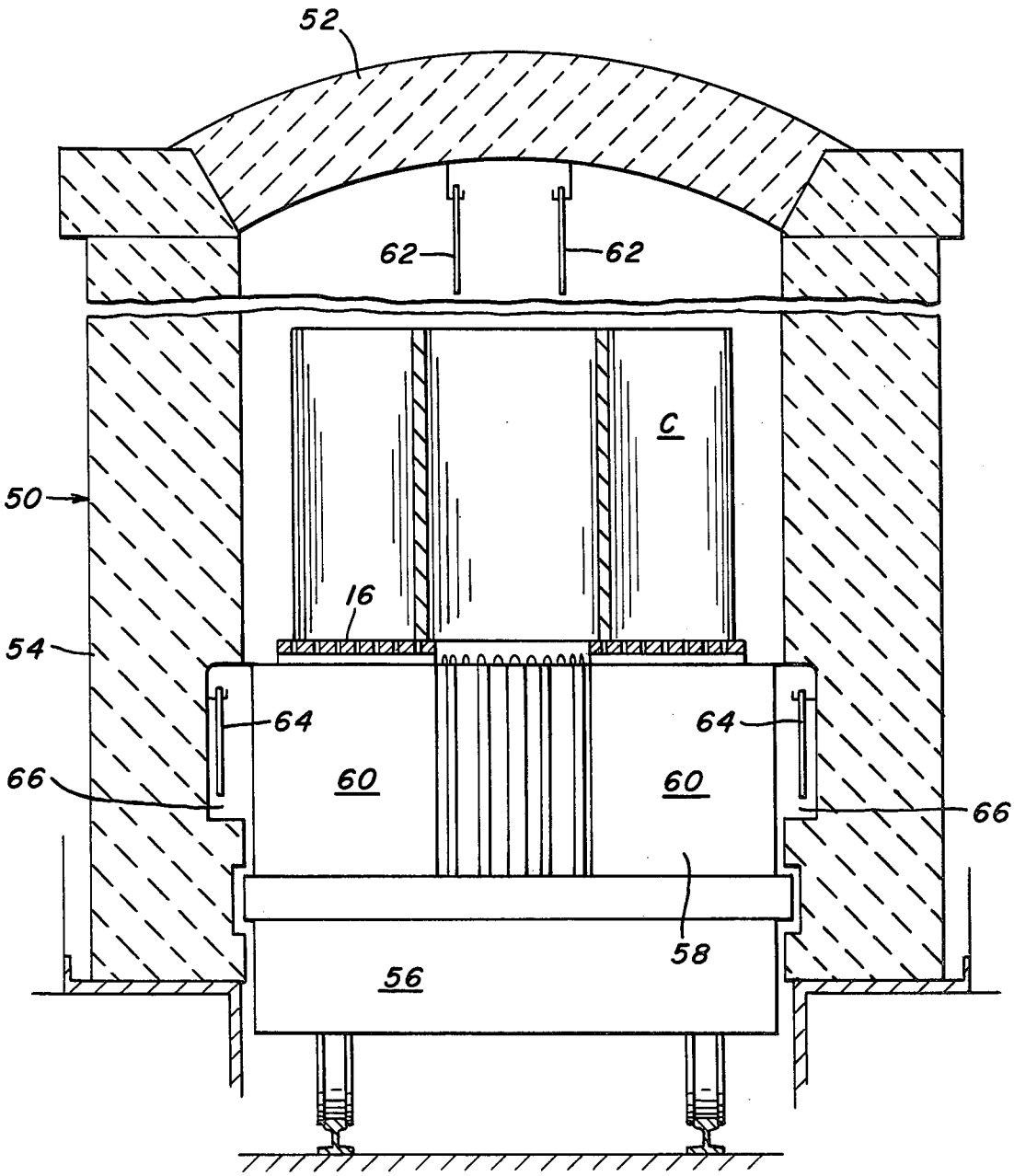
FIG. 6 is a view, similar to FIG. 1, showing my invention incorporated into a tunnel type furnace.

Referring now to FIG. 6, reference numeral 50 indicates a tunnel furnace for annealing coils of strip C. The furnace 50 includes an arched refractory roof 52 supported by refractory sidewalls 54. A conveyor 56 supports a refractory base 58 having openings 60 therein so annealing gas can circulate through the eye of the coil. A convector coil support 16 is mounted on base 58 and in turn supports a coil of strip C. Electrical heating elements 62 are mounted on roof 52 in any suitable manner and similar heating elements 64 are mounted in recesses 66 in walls 54 below the convector coil support 16. It will be understood that other heating means, such as combustion tubes may be used in place of the electrical heating elements. While only one coil of strip C is shown it will be understood that a plurality of coils will be mounted on base plate 12 or on a plurality of spaced apart base plates with the coils being charged into one end of the furnace and discharged from the other end. All the above construction and procedure are conventional except for the location of the heating means and the coil support 16.

The furnace is operated in the usual manner, but the radiant heat from the heating elements is supplied to the top end and bottom ends of the coils rather than to the outer convolutions of the coils. Like in the bell type furnace heat is supplied to the coils primarily from their ends with the heat being supplied to the outer convolutions of the coil from the annealing gas flowing therepast being insufficient to damage the outer convolutions.

While several embodiments have been shown and described in detail, it will be readily apparent to those skilled in the art that various adaptations and modifications may be made within the scope of the invention.

I claim:

1. An apparatus for annealing stacked coils of metal strip having axial openings therethrough comprising:

a furnace having, a roof, sidewalls, a generally horizontally disposed base for supporting a first coil of metal strip with its axial opening disposed in the vertical position, heating means located within said furnace above the plane of the first coil, and heating means adjacent the base;

a first convector coil support between the base and the lowermost coil of strip comprising a generally circular metal plate disposed parallel to the base and having, a central opening therein, a plurality of spaced grooves in the bottom surface of said plate extending radially outwardly from the central opening to the periphery of the metal plate, and a plurality of holes extending through the plate from the grooves to the top surface of said plate; and a second convector coil support between adjacent stacked coils of metal strip comprising a pair of generally circular metal plates, each plate having, one generally planar surface, a central opening therein, a plurality of spaced grooves in the surface opposite the planar surface, said grooves extending radially outwardly from the central opening to the periphery of the metal plate, and a plurality of holes extending through the plate from the grooves to the planar surface, with the plates comprising the second convector coil support disposed between adjacent stacked coils such that the adjacent coils are in contact with a generally planar surface of the coil support, and the central opening and grooves of said plates are disposed toward one another and in axial alignment, a cover enclosing the stack of coils, and means for supplying annealing gas to the center of the stacked coils inside the cover.

2. Apparatus according to claim 1 in which said furnace is a tunnel furnace having a convector for supporting said base with a plurality of coils mounted thereon.

3. Apparatus according to claim 1 in which said furnace is a bell type furnace and said apparatus includes a seal mounted on said base, an inner cover surrounding said first coil and supported in said seal within said roof and sidewalls, and means for circulating an annealing atmosphere gas within said inner cover.

4. An apparatus as set forth in claim 1 including means for fastening the plates comprising the second convector coil support.

* * * * *